United States Patent [19]

Yu

[11] Patent Number: 4,942,105

[45] Date of Patent: Jul. 17, 1990

[54] ELECTROSTATOGRAPHIC IMAGING SYSTEM

[75] Inventor: Robert C. U. Yu, Webster, N.Y.

[73] Assignee: Xerox Corporation, Stamford, Conn.

[21] Appl. No.: 293,050

[22] Filed: Jan. 3, 1989

[51] Int. Cl.[5] ..... G03G 5/14; G03G 13/22

[52] U.S. Cl. ..... 430/59; 430/56; 430/533; 430/535; 430/930; 430/126

[58] Field of Search ..... 430/56, 59, 533, 535, 430/930

[56] References Cited

U.S. PATENT DOCUMENTS 3,495,984 2/1970 Vanpoecke et al. .
3,725,070 4/1973 Hamb et al. .
3,793,249 2/1974 Hamb et al. .
3,856,751 12/1974 Wilson .
4,132,833 1/1979 Sandhu ..... 428/481
4,654,284 3/1987 Yu et al. ..... 430/59

*Primary Examiner*—Roland E. Martin
*Attorney, Agent, or Firm*—Peter H. Kondo

[57] ABSTRACT

A flexible electrophotographic imaging member comprising at least one electrophotographic imaging layer, a supporting substrate layer having an electrically conductive surface and an anti-curl layer, the anti-curl layer comprising a film forming binder and from about 3 percent by weight to about 30 percent by weight, based on the total weight of said anti-curl backing layer, of a copolyester resin reaction product of terephthalic acid, isophthalic acid, ethylene glycol and 2,2-dimethyl-1-propane diol. This flexible electrophotographic imaging member is cycled in an electrostatographic imaging system to produce toner images.

13 Claims, No Drawings

ELECTROSTATOGRAPHIC IMAGING SYSTEM

BACKGROUND OF THE INVENTION

This invention relates in general to electrostatography and, more specifically, to a flexible electrophotoconductive imaging member having an anti-curl backing layer.

In the art of xerography, a xerographic plate comprising a photoconductive insulating layer is imaged by first uniformly depositing an electrostatic charge on the imaging surface of the xerographic plate and then exposing the plate to a pattern of activating electromagnetic radiation such as light which selectively dissipates the charge in the illuminated areas of the plate while leaving behind an electrostatic latent image in the non-illuminated areas. This electrostatic latent image may then be developed to form a visible image by depositing finely divided electroscopic marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. One layer comprises a photoconductive layer which is capable of photogenerating holes and injecting the photogenerated holes into a contiguous charge transport layer. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic resin web. Obviously, the conductive layer may also function as an electrode when the charge transport layer is sandwiched between the conductive layer and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. Nos. 4,265,990 and 4,439,507 are incorporated herein in their entirely. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles.

When one or more photoconductive layers are applied to a flexible supporting substrate, it has been found that the resulting photoconductive member tends to curl. Curling is undesirable because different segments of the imaging surface of the photoconductive member are located at different distances from charging devices, developer applicators and the like during the electrophotographic imaging process thereby adversely affecting the quality of the ultimate developed images. For example, non-uniform charging distances can be manifested as variations in high background deposits during development of electrostatic latent images. Coatings may be applied to the side of the supporting substrate opposite the photoconductive layer to counteract the tendency to curl. However, difficulties have been encountered with these anti-curl coatings. Anti-curl layers will also occasionally delaminate due to poor adhesion to the supporting substrate. Delamination is particularly troublesome in high speed automatic copiers, duplicators and printers which require extended cycling of the photoreceptor belt. For example, delamination has occured in as few as 8,000 cycles. Moreover, delamination is accelerated when the belts are cycled around small diameter rollers and rods.

INFORMATION DISCLOSURE STATEMENT

U.S. Pat. No. 4,654,284 issued to Yu et al on March 31, 1987—An electrophotographic imaging member is disclosed comprising a flexible support substrate layer having an anti-curl layer, the anti-curl layer comprising a film forming binder, crystalline particles dispersed in the film forming binder and a reaction product of a bi-functional chemical coupling agent with both the binder and the crystalline particles. The use of Vitel PE 100 in the anti-curl layer is described, for example, in the Working Examples.

U.S. Pat. No. 3,856,751 issued to Wilson on December 24, 1974—A polyester for use as a photographic element is formed by the condensation of a diacid with a xanthylium ion having appending oxygen substituted benzo rings. A second repeating unit can also be present which is an ester of a diacid and an aliphatic or aromatic diol. Exemplary dicarboxylic acids which can be employed include isophthalic and terephthalic acids, e.g. see column 3, lines 34 and 35. A list of exemplary alkylene glycols including ethylene glycol, 1,2-propanediol, and 1,3-propanediol can be found at column 5, lines 17–24.

U.S. Pat. No. 3,725,070 issued to Hamb et al on April 3, 1973—A linear polyester material is disclosed which is esterified with two or more dissimilar diol units and terephthalic acid units. The linear polyesters are useful as supports for photographic elements. A summary of the potential substituent units for each polyester may be found in column 2.

U.S. Pat. No. 3,793,249 issued to Hamb et al on February 19, 1974—A linear polyester material is disclosed which is esterified with two or more dissimilar diol units and terephthalic acid units. The linear polyesters are useful as supports for photographic elements. A summary of the potential substituent units for each polyester may be found in column 2.

U.S. Pat. No. 3,495,984 issued to Vanpoecke et al on February 17, 1970—A multilayer photographic film is disclosed which includes a supporting layer comprising a mixture of cellulose triacetate and a polyester of at least one phthalic acid and at least one aliphatic diol. The use of a polyester of isophthalic acid, at least one aliphatic saturated carboxylic acid, and at least one aliphatic diol can be found, for example, at column 3, lines 56–63.

U.S. Pat. No. 4,132,833 issued to Sandhu on January 2, 1979—An aromatic polyester for a dye receiving element is disclosed having recurring units of a diol and a dicarboxylic acid.

Thus, the characteristics of electrostatographic imaging members comprising a supporting substrate coated on one side with at least one photoconductive layer and coated on the other side with an anti-curl layer exhibit deficiencies which are undesirable in automatic, cyclic electrostatographic copiers, duplicators, and printers.

SUMMARY OF THE INVENTION

It is an object of the invention to provide an electrophotographic imaging member which overcomes the above-noted disadvantages.

It is still another object of this invention to provide an electrophotographic imaging member which resists delamination between an anti-curl backing layer and the adjacent supporting substrate.

It is still another object of this invention to provide an electrophotographic imaging member having an anti-curl layer with improved adhesion to a supporting substrate.

The foregoing objects and others are accomplished in accordance with this invention by providing a flexible electrophotographic imaging member comprising at least one electrophotographic imaging layer, a supporting substrate layer having an electrically conductive surface and an anti-curl layer, the anti-curl layer comprising a film forming binder and from about 3 percent by weight to about 30 percent by weight, based on the total weight of said anti-curl backing layer, of a copolyester resin reaction product of terephthalic acid, isophthalic acid, ethylene glycol and 2,2-dimethyl-1-propane diol. This flexible electrophotographic imaging member is cycled in an electrostatographic imaging system to produce toner images.

The flexible supporting substrate layer having an electrically conductive surface may comprise any suitable flexible web or sheet. The flexible supporting substrate layer having an electrically conductive surface may be opaque or substantially transparent and may comprise numerous suitable materials having the required mechanical properties. For example, it may comprise an underlying flexible insulating support layer coated with a flexible electrically conductive layer, or merely a flexible conductive layer having sufficient internal strength to support the electrophotoconductive layer and anti-curl layer. The flexible electrically conductive layer, which may comprise the entire supporting substrate or merely be present as a coating on an underlying flexible web member, may comprise any suitable electrically conductive material including, for example, aluminum, titanium, nickel, chromium, brass, gold, stainless steel, carbon black, graphite and the like. The flexible conductive layer may vary in thickness over substantially wide ranges depending on the desired use of the electrophotoconductive member. For highly flexible photoresponsive imaging device is desired, the thickness of the conductive layer may be between about 50 Angstrom units to about 1,000 Angstrom units. Any underlying flexible support layer may be of any conventional material including metal, plastics and the like. Typical underlying flexible support layers include insulating non-conducting materials comprising various resins known for this purpose including polyesters, polycarbonates, polyamides, polyurethanes, and the like. The coated or uncoated flexible supporting substrate layer is normally flexible and may have any number of different configurations such as, for example, a sheet, a cylinder, a scroll, an endless flexible belt, and the like. Preferably, the insulating web is in the form of an endless flexible belt and comprises a commercially available polyethylene terephthalate polyester known as Mylar available from E. I. du Pont de Nemours & Co. A satisfactory range thicknesses for a continuous polyethylene terephthalate belt is less than about 15 mils (380 micrometers). The preferred thickness range is between about 2 mils (50 micrometers) and about 12 mils (305 micrometers) and an optimum thickness range is between about 3 mils (76 micrometers) and about 5 mils (125 micrometers). The substrate should be thin enough to allow flexing. Generally, the thicker substrates perform better over larger diameter rollers.

If desired, any suitable charge blocking layer may be interposed between the conductive layer and the electrophotographic imaging layer. Some materials can form a layer which functions as both an adhesive layer and charge blocking layer. Any suitable blocking layer material capable of trapping charge carriers may be utilized. Typical blocking layers include polyvinylbutyral, organosilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because cyclic stability is extended. The entire disclosure of U.S. Pat. No. 4,464,450 is incorporated herein by reference. The specific silanes employed to form the preferred blocking layer are identical to the preferred silanes employed to treat the crystalline particles of this invention. In other words, silanes having the following structural formula:

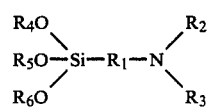

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethylene-amino) group, and $R_4$, $R_5$, and $R_6$ are independently selected from a lower alkyl group containing 1 to 4 carbon atoms. Typical hydrolyzable silanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylethoxy) silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof. The blocking layer forming hydrolyzed silane solution may be prepared by adding sufficient water to hydrolyze the alkoxy groups attached to the silicon atom to form a solution. Any suitable technique may be utilized to apply the hydrolyzed silane solution to the conductive layer. Typical application techniques include spraying, dip coating, roll coating, wire wound rod coating, and the like. Generally, satisfactory results may be achieved when the reaction product of the hydrolyzed silane forms a blocking layer having a thickness between about 20 Angstroms and about 2,000 Angstroms.

In some cases, intermediate layers between the blocking layer and the adjacent charge generating or photogenerating material may be desired to improve adhesion or to act as an electrical barrier layer. If such layers are utilized, they preferably have a dry thickness between abut 0.01 micrometer to about 5 micrometers. Typical adhesive layers include film-forming polymers such as polyester, polyvinylbutyral, polyvinylpyrolidone, polyurethane, polymethyl methacrylate and the like.

Generally, the electrophotoconductive imaging member of this invention comprises an anti-curl layer, a supporting substrate layer and an electrophotographic imaging layer. The electrophotographic imaging layer may comprise a single layer or multilayers. The layer may contain homogeneous, heterogeneous, inorganic or organic compositions. One example of an electrophotographic imaging layer containing a heterogeneous composition is described in U.S. Pat. No. 3,121,006 wherein finely divided particles of a photoconductive inorganic compound is dispersed in an electrically insulating organic resin binder. The entire disclosure of this patent is incorporated herein by reference. Other well known electrophotographic imaging layers include amorphous selenium, halogen doped amorphous selenium, amorphous selenium alloys including selenium arsenic, selenium tellurium, selenium arsenic antimony, and halogen doped selenium alloys, cadmium sulfide and the like. Generally, these inorganic photoconductive materials are deposited as a relatively homogeneous layer.

This invention is particularly desirable for electrophotographic imaging layers which comprise two electrically operative layers, a charge generating layer and a charge transport layer.

Any suitable charge generating or photogenerating material may be employed as one of the two electrically operative layers in the multilayer photoconductor of this invention. Typical charge generating materials include metal free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. Nos. 4,265,990, 4,233,384, 4,471,041, 4,489,143, 4,507,480, 4,306,008, 4,299,897, 4,232,102, 4,233,383, 4,415,639 and 4,439,507. The disclosures of these patents are incorporated herein by reference in their entirety.

Any suitable inactive resin binder material may be employed in the charge generator layer. Typical organic resinous binders include polycarbonates, vinyl polymers, cellulose polymers, polyacrylates, polyesters, polysiloxanes, polyamides, polyurethanes, epoxies, and the like. Many organic resinous binders are disclosed, for example, in U.S. Pat. Nos. 3,121,006 and 4,439,507, the entire disclosures of which are incorporated herein by reference. Organic resinous polymers may be block, random or alternating copolymers. The photogenerating composition or pigment is present in the resinous binder composition in various amounts. When using an electrically inactive or insulating resin, it is essential that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly-N-vinylcarbazole, a photoconductive material need only to comprise about 1 percent or less by volume of the binder layer with no limitation on the maximum amount of photoconductor in the binder layer. Generally for generator layers containing an electrically active matrix or binder such as polyvinyl carbazole or poly(hydroxyether), from about 5 percent by volume to about 60 percent by volume of the photogenerating pigment is dispersed in about 40 percent by volume to about 95 percent by volume of binder, and preferably from about 7 percent to about 30 percent by volume of the photogenerating pigment is dispersed in from about 70 percent by volume to about 93 percent by volume of the binder The specific proportions selected also depends to some extent on the thickness of the generator layer.

The thickness of the photogenerating binder layer is not particularly critical. Layer thickness from about 0.05 micrometer to about 40.0 micrometers have been found to be satisfactory. The photogenerating binder layer containing photoconductive compositions and/or pigments, and the resinous binder material preferably ranges in thickness of from about 0.1 micrometer to about 5.0 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The active charge transport layer may comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to a wavelength of light useful in xerography, e.g. 4,000 Angstroms to 10,000 Angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active transport material need not be absorbing in the wavelength region of use. The charge transport layer in conjunction with the generation layer in the instant invention is a material which is an insulator to the extent that an electrostatic charge placed on the transport layer is not conductive in the absence of illumination, i.e. a rate sufficient to prevent the formation and retention of an electrostatic latent image thereon.

Polymers having this characteristic, e.g. capability of transporting holes, have been found to contain repeating units of a polynuclear aromatic hydrocarbon which may also contain heteroatoms such as for example, nitrogen, oxygen or sulfur. Typical polymers include poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

Preferred electrically active layers comprise an electrically inactive resin material, e.g. a polycarbonate made electrically active by the addition of one or more of the following compounds poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

An especially preferred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resin in which the aromatic amine is soluble.

The charge transport layer forming mixture preferably comprises an aromatic amine compound of one or more compounds having the general formula:

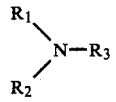

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups, and the like. Typical aromatic amine compounds that are represented by this structural formula include:

I. Triphenyl amines such as:

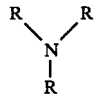

II. Bis and poly triarylamines such as:

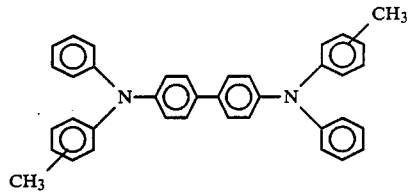

III. Bis arylamine ethers such as:

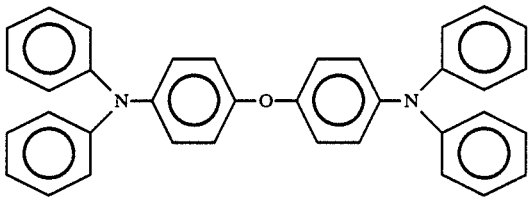

IV. Bis alkyl-arylamines such as:

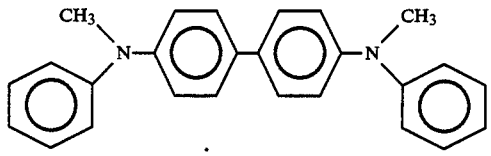

A preferred aromatic amine compound has the general formula:

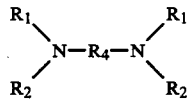

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free form electron withdrawing groups such as $NO_2$ groups, CN groups, and the like.

Excellent results in controlling dark decay and background voltage effects have been achieved when the imaging members comprising a charge generation layer comprise a layer of photoconductive material and a contiguous charge transport layer of a polycarbonate resin material having a molecular weight of from about 20,000 to about 120,000 having dispersed therein from about 25 to about 75 percent by weight of one or more diamine compounds having the general formula:

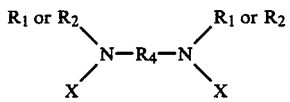

wherein $R_1$, $R_2$, and $R_4$ are defined above and X is selected from the group consisting of an alkyl group having from 1 to about 4 carbon atoms and chlorine, the photoconductive layer exhibiting the capability of photogeneration of holes and injection of the holes and the charge transport layer being substantially nonabsorbing in the spectral region at which the photoconductive layer generates and injects photogenerated holes but being capable of supporting the injection of photogenerated holes from the photoconductive layer and transporting said holes through the charge transport layer.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl) phenylmethane; 4'-4''-bis(diethylamino)-2',2''-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000.

The preferred electrically inactive resin materials are polycarbonate resins have a molecular weight from about 20,000 to about 100,000, more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G. and a polycarbonate resin having a molecular weight of from about 20,000 to about 50,000 available as Merlon from Mobay Chemical Company. Methylene chloride solvent is a desirable component of the charge transport layer coating mixture for adequate dissolving of all the components and for its low boiling point.

Alternatively, as previously mentioned, the active layer may comprise a photogenerated electron transport material, for example, trinitrofluorenone, poly-N-vinyl carbazole/trinitrofluorenone in a 1:1 mole ratio, and the like.

In all of the above charge transport layers, the activating compound which renders the electrically inactive polymeric material electrically active should be present in amounts of from about 15 to about 75 percent by weight.

Any suitable and conventional technique may be utilized to mix and thereafter apply the charge transport layer coating mixture to the charge generating layer. Typical application techniques include spraying, dip coating, roll coating, wire wound rod coating, and the like. Although it is preferred that the acid doped methylene chloride be prepared prior to application to the charge generating layer, one may instead add the acid to the aromatic amine, to the resin binder or to any combination of the transport layer components prior to coating. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1. A typical transport layer forming composition is about 8.5 percent by weight charge transporting aromatic amine, about 8.5 percent by weight polymeric binder, and about 83 percent by weight methylene chloride. The methylene chloride can contain from about 0.1 ppm to about 1,000 ppm protonic or Lewis acid based on the of weight methylene chloride.

Optionally, an overcoat layer may also be utilized to improve resistance to abrasion. These overcoating layers may comprise organic polymers or inorganic polymers that are electrically insulating or slightly semi-conductive.

Any suitable film forming binder may be utilized in the anti-curl layer. The film forming binder should be a flexible thermoplastic resin which is compatible with and does not phase separate from the copolyester of this invention. Typical thermoplastic resins include polyacrylates, polystyrene-butadiene-acrylonitrile, polyether sulfone, polycarbonates such as poly(4,4'-isopropylidenediphenyl carbonate) and poly[1,1-cyclohexanebis(4-phenyl)carbonate], polyesters, polyurethanes, acrylate polymers, cellulose polymers, polyamides, nylon, polybutadiene, poly(vinyl chloride), polyisobutylene, polyethylene, polypropylene, polyterephthalate, polystryrene, styrene-acrylonitrile copolymer, and the like and mixtures thereof. The thermoplastic resins should have $T_g$ of at least about 40° C. to achieve a coated film having good beam strength, flexural strength, and nontackiness. A film forming binder of polycarbonate resin is particularly preferred because of its excellent adhesion to adjacent layers and transparency to activating radiation. The in addition to the film forming binder, the anti-curl layer should also contain between about 3 percent by weight and about 30 percent by weight, based on the total weight of the anti-curl backing layer, of a film forming reaction product of terephthalic acid, isophthalic acid, ethylene glycol and 2,2-dimethal-1-propane diol. This film forming reaction product is available from Goodyear Tire & Rubber Co. as Vitel PE-200. This polyester resin is a linear saturated copolyester of two diacids and two diols. The molecular structure of this linear saturated copolyester is represented by the following:

$$HO\overset{\overset{O}{\|}}{C}-[\text{Diacid-Diol}]_n-OH$$

where the mole ratio of diacid to ethylene glycol in the copolyester is 1:1. The diacids are terephthalic acid and isophthalic acid. The mole ratio of terephthalic acid to isophthalic acid is 1.2:1. The molecular structures of these acids are as follows: The two diols are ethylene glycol and 2,2-dimethyl propane diol. The terephthalic acid

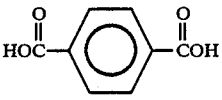

isophthalic acid

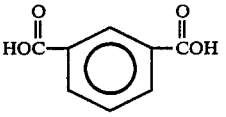

mole ratio of ethylene glycol to dimethyl propane diol is 1.33:1. The molecular structures of ethylene glycol and 2,2-dimethyl propane diol are as follows:

ethylene glycol $HO-CH_2CH_2-OH$

-continued 2,2-Dimethyl Propane Diol $HOCH_2-\overset{\overset{CH_3}{|}}{\underset{\underset{CH_3}{|}}{C}}-CH_2OH$ The Goodyear PE-200 linear saturated copolyester consists of randomly alternating monomer units of the two diacids and the two diols in the above indicated ratio and has a molecular weight of about 45,000 and a $T_g$ of about 67° C. Satisfactory results may be achieved when the glass transition temperature of the copolyester resin utilized in the anti-curl backing layer of this invention has a glass transition temperature of between about 40° C. and about 100° C. The glass transition temperature between about 50° C. and about 80° C. is preferred. Optimum results are achieved when a copolyester resin reaction product having a glass transition temperature between about 55° C. and about 70° C. Satisfactory results may be obtained with a weight average molecular weight for the copolyester resin reaction product of between about 25,000 and 100,000. A weight average molecular weight of 30,000 to about 70,000 is preferred and optimum results are achieved with a weight average molecular weight of between about 40,000 and about 55,000. When the molecular weight exceeds about 100,000, the anti-curl layer is difficult to fabricate because the copolyester does not dissolve in conventional organic solvents. When the glass transition temperature is less than about 40° C. the anti-curl layer become too tacky for convenient handling. The diacid:-diol mole ratio is about 1:1 . The satisfactory mole ratio range for terephthalic acid to isophthalic acid is between about 2:1 and about 1:1. Preferably, the mole ratio is between about 1.5:1 and about 1:1 and the optimum ratio is about 1.2:1. The satisfactory mole ratio range for ethylene glycol to dimethyl diol is between about 2:1 and about 1:1. Preferably, the mole ratio is between about 1.5:1 and about 1.25:1 and the optimum ratio is about 1.33:1.

Surprisingly, when a closely related polyester available from Goodyear Tire & Rubber Co. as Vitel PE-100, is substituted for PE-200 in an anti-curl backing layer of a multi-layered photoreceptor at a loading of about 1 percent by weight PE-100, adhesion as well as resistance to delamination is insufficient to prevent delamination during extended cycling in an automatic xerographic machine. Moreover, the tendency of the multi-layered photoreceptor to delaminate between the anti-curl layer and substrate became worse when higher concentrations of PE-100 was added to the anti-curl backing layer. Thus, the presence of higher concentrations of PE-100, e.g., 8 percent by weight, tended to perform poorly and delaminate earlier than if 1 percent PE-100 is utilized.

PE-100 polyester resin is a linear saturated copolyester of two diacids and ethylene glycol. The molecular structure of PE-100 linear saturated copolyester is represented by the following:

$$HO\overset{\overset{O}{\|}}{C}-[\text{diacid-ethylene glycol}]_n-OH$$

where the ratio of diacid to ethylene glycol in the copolyester is 1:1. The diacids are terephthalic acid and isophthalic acid. The ratio of terephthalic acid to isophthalic acid is 3:2. The molecular structures of these acids and ethylene glycol are presented above in the discussion relating to PE-200. The Vitel PE-100 linear saturated copolyester consists of alternating monomer units of ethylene glycol and two randomly sequenced diacids in the above indicated ratio and has a molecular weight of about 50,000 and a $T_g$ of about 71° C.

Any suitable crystalline particle having reactive hydroxyl groups chemically attached to metal or metalloid atoms located on the outer surface of the particles may optionally be employed in the anti-curl layer. The expression "crystalline" is defined as an inorganic material having a regular shape determined by an orderly three-dimensional atomic lattice work. Typical metal and metalloid atoms include silicon, titanium, zirconium, aluminum, and the like. The crystalline particles may have any suitable outer shape. Typical outer shapes include irregular, granular, elliptical, cubic, flake, and the like. The crystalline particles should have a hardness greater than about 2.5 Mohs for satisfactory improvement in wear resistance against mechanical contact with materials such as glass, metals, composites, and the like. A hardness greater than about 4.5 Mohs is preferred for optimum operating longevity. Typical crystalline particles include euhedral quartz crystal, sandstone, quartzite sand, quartz rock, novaculite, silicon dioxide, aluminum oxide, titanium dioxide, mica, Wollastonite, and the like. Preferably, the crystalline particles should have a particle size less than the thickness of the anti-curl layer to avoid an anti-curl layer having an irregular outer surface. An average crystalline particle size between about 0.3 micrometer and about 5 micrometers is preferred because protrusion of the particles through the outer surface of the anti-curl layer is minimized or eliminated with particles less than about 5 micrometers and inter particle agglomeration is minimized with a particle size greater than about 0.3 micrometer. For optimum transparency, the treated crystalline particles should have a refractive index within about 0.5 of that of the hardened film forming binder.

Generall, the anti-curl layer comprises from about 0.1 percent by weight to about 30 percent by weight of crystalline particles, based on the total weight of the anti-curl layer. A concentration of crystalline particles greater than about 30 percent by weight renders the anti-curl coating more difficult to apply, makes the transport layer more susceptible to scratches caused by contact with the anti-curl layer during rolling and unrolling, and causes the anti-curl coating to be less stable as a dispersion. At a loading exceeding about 20 percent by weight optical clarity begins to fall off. When less than about 2 percent by weight of the crystalline particles are utilized, the improvement in wear resistance is relatively slight but some improvement in transport the web through coating machinery is achieved even with crystalline silica particle concentrations as low as 0.1 percent by weight. Thus, about between 5 percent by weight to about 20 percent by weight of crystalline particles, based on the total weight of the anti-curl layer is preferred.

Any suitable bi-functional chemical coupling agent may be employed to treat the surface of the crystalline particles. The bi-functional chemical coupling agent comprises in a single molecule at least one reactive group which will react with hydroxyl groups on the surface of the crystalline particles and at least one organo functional reactive group which will react with reactive groups on the film forming binder molecules. Selection of the organo functional reactive group for the bi-functional coupling agent molecule depends on the reactive groups present on the film forming resin molecule to employed. Typical reactive groups on the bi-functional chemical coupling agent that react with reactive groups on thermoplastic resins include vinyl, amino, azido, amino, epoxide, halogen, sulfite, and the like. Thus, the crystalline particles and bi-functional coupling agent are chemically bonded to each other through an oxygen atom and the bi-functional coupling agent and film forming binder are also chemically bonded to each other. Typical reactive groups on bi-functional coupling agents which will react with the hydroxy groups on the surface of the crystalline particles include alkoxy, acetoxy, hydroxy, carboxy and the like. The hydrolyzable groups on the coupling agents react directly, chemically attaching themselves to the particles. For example, for crystalline silica particles, the hydrolyzable ends of the bi-functional silane coupling agents attach to the hydroxyl groups on the outer surface of the crystalline particles via silanols (SiOH) groups formed through hydrolysis of the hydrolyzable groups. Typical bi-functional chemical coupling agents include organosilanes having these characteristics include amino silanes such as 3-aminopropyl triethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine, N-aminoethyl-3-aminopropyltrimethoxysilane, N-(2-aminoethyl)-3-aminopropyltrimethoxysilane, N-2-aminoethyl-3-aminopropyltris(ethylhethoxy) silane, p-aminophenyl trimethoxysilane, 3-aminopropyldiethylmethylsilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, and 3[2(vinyl benzylamino)ethylamino]propyltrimethoxy silane; halo silanes such as chloropropyltriethoxysilane and (3-chloropropyl)trimethoxy silane; vinyl silanes such as vinyl triethoxy silane, triacetoxyvinyl silane, tris(2-methoxyethoxy)vinyl silane and 3-methacryloxypropyltrimethoxy silane; epoxy silanes such as [2-(3,4-epoxycyclohexylethyltrimthoxy silane; mercaptosilanes such as azido compounds such as AX-CMP MC azido silane and azidotrimethoxy silane; organotitanates, such as neoalkoxy, tri(dioctylphosphato titanate), neoalkoxy, tri(N ethylaminoethylamino) titanate, neoalkoxy, tri(m-amino)phenyl titanate and isopropyl di(4amino benzoyl-)isostearoyl titanate; organozirconates such as neoalkoxy trisneodecanoyl zirconate, neoalkoxy tris(dioctyl)-phosphato zirconate, neoalkoxy tris(dioctyl)pyrphosphata zirconate, neoalkoxy tris(ethylene diamino)ethyl zirconate, neoalkoxy tris(m-amino)phenyl zirconate; and the like and mixtures thereof.

These coupling agents are usually applied to the crystalline particles prior to dispersion of the crystalline particles into the film forming binder. Any suitable technique may be utilized to apply and react the coupling agent with the surface of the crystalline particles. The deposited coupling agent coating on the crystalline particles are continuous, thin, and preferably in the form of a monolayer. A preferred process for applying the bi-functional chemical coupling agent to the crystalline particles is by stirring the crystalline particles in an aqueous solution of a hydrolyzed silane. After thoroughly wetting the surface of the crystalline particles with the aqueous solution to ensure reaction between the reactive groups on the coupling agent molecule and the hydroxyl groups on the outer surface of the crystalline particles, the treated crystalline particles may be separated from the aqueous solution by any suitable technique such as filtering. The treated crystalline particles may thereafter be dried by conventional means such as oven drying, forced air drying, combinations of vacuum and heat drying, and the like. Other techniques of silylation such as contacting the outer surface of the crystalline particles with vapors or sprays of the bi-functional coupling agent may also be employed. For example, sylylation may be accomplished by pouring or spraying the bi-functional chemical coupling onto the crystalline particles while the crystalline particles are agitated in a high intensity mixer at an elevated temperature. In this blending technique, the coupling agent is reacted with the hydroxyl groups directly attached to metal or metalloid atoms at the surface of the crystalline particles to form a reaction product in which the crystalline particles and the bi-functional coupling agent are chemically bonded to each other through an oxygen atom. Such a process is described, for example, in U.S. Pat. No. 3,915,735, the disclosure of which is incorporated herein by reference in its entirety.

Generally, the concentration of the bi-functional coupling agent in the treating solution should be sufficient to provide at least a continuous mono molecular layer of coupling agent on the surface of the crystalline particles. Satisfactory results may be obtained with an aqueous solution containing from about 1 percent by weight to about 5 percent by weight of coupling agent based on the weight of the solution. After drying, the crystalline particles coated with the reaction product of the bi-functional coupling agent and hydroxyl groups attached to the metal or metalloid atoms on the outer surface of the crystalline particles are dispersed in the film forming binder where further reaction occurs between the reactive organo functional groups of the bi-functional coupling agent and reactive groups on the film forming binder molecules. Dispersion may be effected by any suitable conventional mixing technique such as blending the treated silica particles with a molten thermoplastic resin or in a solution of the resin in a solvent.

Typical combinations of bi-functional chemical coupling agents and film forming binder polymers having reactive groups include 3-aminopropyl triethoxy silane and polycarbonate; tris(2-methoxyethoxy)vinyl silane and polyethylene; 4-aminopropyl triethoxy silane and nylon; [3-(2-aminoethylamino)propyl]trimethoxy silane and nylon; 3-methacryloxypropyltrimethoxy silane and polyester; (3-glycidoxypropyl)trimethoxy silane and polycarbonate; 4-aminopropyl triethoxy silane and poly(vinylchloride); vinyltris(2-methoxyethoxy) silane and polystyrene; and the like.

Aminosilane bi-functional chemical coupling agents are preferred because the amine functionality forms an excellent chemical bond through its reaction with COOH and OH groups of film forming binder polymers and excellent chemical bonding through an oxygen atom to the crystalline particles. These silanes are applied in hydrolyzed form because the OH groups of the silane will readily condense with the silanol groups on the crystalline particle surfaces and position the organofunctional amine group of the silane for reaction with the reactive group on the film forming binder polymer.

The preferred hydrolyzed silane has the general formula:

I

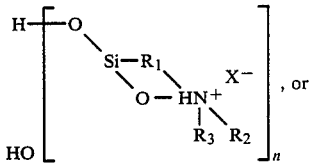

, or

II

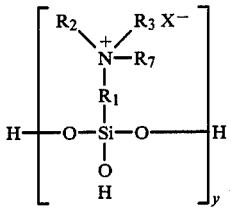

or mixtures thereof, wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is a hydroxyl group or an anion of an acid or acidic salt, n is 1, 2, 3 or 4, and y is 1, 2, 3 or 4.

The hydrolyzed silane may be prepared by hydrolyzing an aminosilane having the following structural formula:

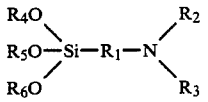

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethylene-amino) group, and $R_4$, $R_5$, and $R_6$ are independently selected from a lower alkyl containing 1 to 4 carbon atoms. Typical hydrolyzable aminosilanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylethoxy) silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof. The preferred silane materials are 3-aminopropyltriethoxysilane, N-aminoethyl-3-aminopropyltrimethoxysilane, (N,N'-dimethyl 3-amino)propyltriethoxysilane, or mixtures thereof because the hydrolyzed solutions of these materials exhibit a greater degree of basicity and stability and because these materials are readily available commercially.

If $R_1$ is extended into a long chain, the compound becomes less stable. Silanes in which $R_1$ contains about 3 to about 6 carbon atoms are preferred because the oligomer is more stable. Optimum results are achieved when $R_1$ contains 3 carbon atoms. Satisfactory results are achieved when $R_2$ and $R_3$ are alkyl groups. Optimum stable solutions are formed with hydrolyzed silanes in which $R_2$ and $R_3$ are hydrogen. Satisfactory hydrolysis of the silane may be effected when $R_4$, $R_5$ and $R_6$ are alkyl groups containing 1 to 4 carbon atoms. When the alkyl groups exceed 4 carbon atoms, hydrolysis becomes impractically slow. However, hydrolysis of silanes with alkyl groups containing 2 carbon atoms are preferred for best results.

During hydrolysis of the amino silanes described above, the alkoxy groups are replaced with hydroxyl groups. As hydrolysis continues, the hydrolyzed silane takes on the following intermediate structure:

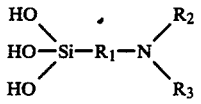

After drying, the reaction product layer formed from the hydrolyzed silane contains larger molecules in which n is equal to or greater than 6. The reaction product of the hydrolyzed silane may be linear, partially crosslinked, a dimer, a trimer, and the like.

The hydrolyzed silane solution utilized to treat the crystalline particles may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product layers may be achieved with solutions containing from about 0.1 percent by weight to about 10 percent by weight of the silane based on the total weight of solution. A solution containing from about 0.1 percent by weight to about 2.5 percent by weight silane based on the total weight of solution are preferred for stable solutions which form a uniform reaction product layer on the crystalline particles. The thickness of the reaction product layer is estimated to be between about 20 Angstroms and about 2,000 Angstroms.

A solution pH between about 4 and about 14 may be employed. Optimum reaction product layers on the crystalline particles are achieved with hydrolyzed silane solutions having a pH between about 9 and about 13. Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorosilicic acid, Bromocresol Green, Bromophenol Blue, p-toluene sulphonic acid and the like.

If desired, the aqueous solution of hydrolyzed silane may also contain additives such as polar solvents other than water to promote the silylation process of involving the crystalline particles. Any suitable polar solvent other than water may be employed. Typical polar solvents include methanol, ethanol, isopropanol, tetrahydrofuran, methoxyethanol, ethoxyethanol, ethylacetate, ethylformate and mixtures thereof.

Any suitable technique may be utilized to treat the crystalline particles with the reaction product of the hydrolyzed silane. For example, washed crystalline silica can be swirled in a hydrolyzed silane solution for between about 1 minute and about 60 minutes and then the solids thereafter allowed to settle out and remain in contact with the hydrolyzed silane for between about 1 minute and about 60 minutes. The supernatent liquid may then be decanted and the treated crystalline silica filtered with filter paper. The crystalline silica may be dried at between about 1 minute and about 60 minutes at between about 80° C. and about 165° C. in a forced air oven for between about 1 minute and about 60 minutes. If desired, hydrolysis of the silane may be effected at the surface of the crystalline particles as described, for example, in Example 2 of U.S. Pat. No. 3,915,735.

Crystalline particles treated with bi-functional silane coupling agents are also commercially available. For example, crystalline silica particles reacted with an amino silane are available as SSO212 from Petrarch Systems, Inc. and crystalline silica particles reacted with 3-chloropropyltrimethoxy silane are available as SSO214 from Petrarch Systems, Inc.

The use of crystalline particles treated with bi-functional silane coupling agents in anti-curl backing layers for electrophotographic imaging members is described in detail in U.S. Pat. No. 4,654,284 to Yu et al, the entire disclosure thereof being incorporated herein by reference.

Any suitable additives may be employed in the anti-curl backing layer. Typical additives include dyes, fillers, and the like. Generally, the amount of additives in the anti-curl backing layer is less than about 10 percent by weight based on the total weight of the anti-curl backing layer.

Any suitable conventional coating technique may be utilized to apply the anti-curl layer to the supporting substrate layer. Typical coating techniques include solvent coating, extrusion coating, spray coating, lamination, dip coating, solution spin coating and the like. The deposited anti-curl layer may be dried by any conventional drying technique such as oven drying, forced air drying, circulating air oven drying, radiant heat drying, and the like.

The thickness of the anti-curl layer should be sufficient to substantially balance the total forces of the layer or layers on the opposite side of the supporting substrate layer substrate. The total forces are substantially balanced when the electrophotographic imaging member has no noticeable tendency to curl after all layers are dried. For example, for an electrophotographic imaging member in which the bulk of the coating thickness on the photoreceptor side of the imaging member was a transport layer containing predominantly polycarbonate resin and having a thickness of about 24 micrometers, on a Mylar substrate having a thickness of about 76 micrometers, sufficient balance of forces were achieved with a 13.5 micrometers thick anti-curl layer containing 92 percent by weight polycarbonate resin, 8 percent by weight copolyester of this invention, and between about 2 and about 20 percent by weight of the bi-functional coupling agent treated crystalline particles of this invention, all weights being based on the total weight of the dried anti-curl layer. Similar results were obtained when the transport layer had a thickness of about 31 micrometers and the anti-curl layer on the other side of a Mylar film had a thickness of about 17 micrometers.

Surprisingly, the use of the copolyester of this invention provides significantly superior results in anti-curl layers compared to anti-curl layers without the copolyester. Moreover, the use of the copolyester of this invention in combination with bi-functional coupling agent treated silica particles in anti-curl layers provides markedly better results than anti-curl layers with the copolyester, but without bi-functional coupling agent treated silica particles.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A photoconductive imaging member was prepared by providing a titanium coated polyethylene terephthalate (Melinex, available from ICI Inc.) substrate having a thickness of 3 mils (76.1 micrometers) and applying thereto, using a Bird applicator, a solution containing 2.592 gm 3-aminopropyltriethoxysilane, 0.784 gm acetic acid, 180 gm of 190 proof denatured alcohol and 77.3 gm heptane. This layer was then allowed to dry for 5 minutes at room temperature and 10 minutes at 135° C. in a forced air oven. The resulting blocking layer had a dry thickness of 0.01 micrometer.

An adhesive interface layer was then prepared by the applying to the blocking layer a coating having a wet thickness of 0.5 mil and containing 0.5 percent by weight based on the total weight of the solution of polyester adhesive (DuPont 49,000, available from E. I. du Pont de Nemours & Co.) in a 70:30 volume ratio mixture of tetrahydrofuran/cyclohexanone with a Bird applicator. The adhesive interface layer was allowed to dry for 1 minute at room temperature and 10 minutes at 100° C. in a forced air oven. The resulting adhesive interface layer had a dry thickness of 0.05 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 0.8 gram polyvinyl carbazole and 14 ml of a 1:1 volume ratio of a mixture of tetrahydrofuran and toluene into a 2 oz. amber bottle. To this solution was added 0.8 gram of trigonal selenium and 100 grams of ⅛ inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl-4,4'-diamine in 7.5 ml of 1:1 volume ratio of tetrahydrofuran/toluene. This slurry was then placed on a shaker for 10 minutes. The resulting slurry was thereafter applied to the adhesive interface with a Bird applicator to form a layer having a wet thickness of 0.5 mil. The layer was dried at 135° C. for 5 minutes in a forced air oven to form a dry thickness photogenerating layer having a thickness of 2.0 microns.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Farbensabricken Bayer A. G. The resulting mixture was dissolved in 15 percent by weight methylene chloride. This solution was applied on the photogenerator layer using a Bird applicator to form a coating which upon drying had a thickness of 25 microns. During this coating process the humidity was equal to or less than 15 percent. The resulting photoreceptor device containing all of the above layers was annealed at 135° C. in a forced air oven for 5 minutes.

An anti-curl coating was prepared by combining 88.2 grams of polycarbonate resin (Makrolon 5705, 8.18 percent by weight solids, available from Bayer A. G.), 0.9 grams of copolyester resin (Vitel PE-100, available from Goodyear Tire and Rubber Co.), and 900.7 grams of methylene chloride in a amber glass bottle to form a coating solution containing 8.9 percent solids. The glass bottle was covered tightly and placed on a roll mill for about 24 hours until the polycarbonate and copolyester were dissolved in the methylene chloride. The anti-curl coating solution was applied to the rear surface (side opposite the photogenerator layer and charge transport layer) of the photoconductive imaging member by Bird applicator coating and dried at 135° C. for about 5 minutes to produce a dried film having a thickness of 13.5 micrometers.

EXAMPLE II

A photoconductive imaging member having two electrically operative layers as described in Example I was prepared using the same procedures and materials except that an anti-curl coating of this invention was substituted for the anti-curl coating described in Example I. The substituted anti-curl coating was prepared by combining 82.0 grams of polycarbonate resin (Makrolon 5705, available from Bayer A. G.), 7.1 grams of copolyester resin (Vitel PE-200, available from Goodyear Tire and Rubber Co.), and 900.7 grams of methylene chloride in a amber glass bottle. The glass bottle was covered tightly and placed on a roll mill for about 24 hours until the polycarbonate and copolyester were dissolved in the methylene chloride. The anti-curl coating solution was applied to the rear surface (side opposite the photogenerator layer and charge transport layer) of the photoconductive imaging member by Bird applicator coating and dried at 135° C. for about 5 minutes to produce a dried film having a thickness of 13.5 micrometers.

EXAMPLE III

A photoconductive imaging member having two electrically operative layers as described in Example II was prepared using the same procedures and materials except that the anti-curl coating was modified with the addition of 9.9 grams (10 percent by weight of the total solids content of the the anti-curl coating) $Cl(CH_2)_3$-Si-$(OCH_3)_3$ (chloropropyltrimethoxysilane) treated crystalline silica particles (available from Petrarch Systems Inc.) in bottle with a high shear dispersing rotor (Tekmar Dispax Disperser). The crystalline silica particles had an irregular shape and an average particle size of about 3.2 micrometers. The treated silica particles comprise the reaction product of the hydrolyzed silane and silanol groups on the surface of the silica particles. This bottle was equipped with a lid and a water jacket to prevent overheating and loss of solvent. The rotor was driven at high speed for 15–30 minutes to disperse the materials. The resulting dispersion was then filtered and applied to a photoconductive imaging member to a form an anti-curl coating containing 10 percent silica. The dried anti-curl coating had a thickness of about 13.5 micrometers. The anti-curl coating solution was applied to the rear surface (side opposite the photogenerator layer and charge transport layer) of the photoconductive imaging member by Bird applicator coating and dried at 135° C. for about 5 minutes to produce a dried film having a thickness of 13.5 micrometers.

EXAMPLE IV

A photoconductive imaging member having two electrically operative layers as described in Example II was prepared using the same procedures and materials except that 4.95 grams of $Cl(CH_2)_3$-Si-$(OCH_3)_3$ (chloropropyltrimethoxysilane) treated crystalline silica particles (available from Petrarch Systems Inc.) was substituted for the treated silica described in Example II. The crystalline silica particles had an irregular shape and an average particle size of about 3.2 micrometers. The treated silica particles comprise the reaction product of the hydrolyzed silane and silanol groups on the surface of the silica particles. The resulting dispersion was then filtered and applied to a photoconductive imaging member to a form an anti-curl coating. The dried anti-curl coating contained 5 percent by weight treated silica particles based on the total weight of the dried anti-curl coating and had a thickness of about 13.5 micrometers.

EXAMPLE V

A photoconductive imaging member having two electrically operative layers as described in Example II was prepared using the same procedures and materials except that 2.5 grams of $Cl(CH_2)_3$-Si-$(OCH_3)_3$ (chloropropyltrimethoxysilane) treated crystalline silica particles (available from Petrarch Systems Inc.) was substituted for the treated silica described in Example III. The crystalline silica particles had an irregular shape and an average particle size of about 3.2 micrometers. The treated silica particles comprise the reaction product of the hydrolyzed silane and silanol groups on the surface of the silica particles. The resulting dispersion was then filtered and applied to a photoconductive imaging member to a form an anti-curl coating containing 2.5 percent by weight treated silica particles based on the total weight of the dried anti-curl coating. The dried anti-curl coating had a thickness of about 13.5 micrometers.

EXAMPLE VI

A photoconductive imaging member having two electrically operative layers as described in Example II was prepared using the same procedures and materials except that 9.9 grams of untreated crystalline silica particles (Malvern 337, available from Malvern Minerals Co.) was substituted for the treated silica described in Example II. The crystalline silica particles had an irregular shape and an average particle size of about 2.8 micrometers. The resulting dispersion was then filtered and applied to a photoconductive imaging member to form an anti-curl coating containing 10 percent by weight untreated silica particles based on the total weight of the dried anti-curl coating. The dried anti-curl coating had a thickness of about 13.5 micrometers.

EXAMPLE VII

A photoconductive imaging member having two electrically operative layers as described in Example II was prepared using the same procedures and materials except that 4.95 grams of untreated crystalline silica particles (Malvern 337, available from Malvern Minerals Co.) was substituted for the treated silica described in Example II. The crystalline silica particles had an irregular shape and an average particle size of about 2.8 micrometers. The resulting dispersion was then filtered and applied to a photoconductive imaging member to form an anti-curl coating containing 5 percent by weight untreated silica particles based on the total weight of the dried anti-curl coating. The dried anti-curl coating had a thickness of about 13.5 micrometers.

EXAMPLE VIII

A photoconductive imaging member having two electrically operative layers as described in Example II was prepared using the same procedures and materials except that 2.5 grams of untreated crystalline silica particles (Malvern 337, available from Malvern Minerals Co.) was substituted for the treated silica described in Example II. The crystalline silica particles had an irregular shape and an average particle size of about 2.8 micrometers. The resulting dispersion was then filtered and applied to a photoconductive imaging member to form an anti-curl coating containing 2.5 percent by weight untreated silica particles based on the total weight of the dried anti-curl coating. The dried anti-curl coating had a thickness of about 13.5 micrometers.

EXAMPLE IX

A photoconductive imaging member having two electrically operative layers as described in Example II was prepared using the same procedures and materials except that 9.9 grams of

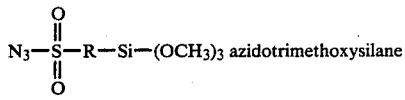

treated crystalline silica particles was substituted for the treated silica described in Example II. The silica particles (Malvern 337, available from Malvern Minerals Co. in untreated form) had an irregular shape and an average particle size of about 2.8 micrometers. The treated silica particles comprise the reaction product of the hydrolyzed silane and silanol groups on the surface of the silica particles. The resulting dispersion was then filtered and applied to a photoconductive imaging member to form an anti-curl coating containing 10 percent by weight treated silica particles based on the total weight of the dried anti-curl coating. The dried anti-curl coating had a thickness of about 13.5 micrometers.

EXAMPLE X

A photoconductive imaging member having two electrically operative layers as described in Example II was prepared using the same procedures and materials except that 4.95 grams of

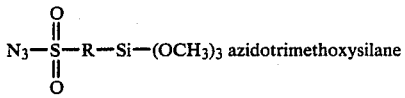

treated crystalline silica particles was substituted for the treated silica described in Example II. The silica particles (Malvern 337, available from Malvern Minerals Co. in untreated form) had an irregular shape and an average particle size of about 2.8 micrometers. The treated silica particles comprise the reaction product of the hydrolyzed silane and silanol groups on the surface of the silica particles. The resulting dispersion was then filtered and applied to a photoconductive imaging member to form an anti-curl coating containing 5 percent by weight treated silica particles based on the total weight of the dried anti-curl coating. The dried anti-curl coating had a thickness of about 13.5 micrometers.

EXAMPLE XI

A photoconductive imaging member having two electrically operative layers as described in Example II was prepared using the same procedures and materials except that 2.5 grams of

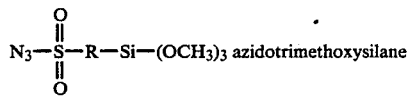

$N_3-\overset{\overset{O}{\|}}{\underset{\underset{O}{\|}}{S}}-R-Si-(OCH_3)_3$ azidotrimethoxysilane treated crystalline silica particles was substituted for the treated silica described in Example II. The silica particles (Malvern 337, available from Malvern Minerals Co. in untreated form) had an irregular shape and an average particle size of about 2.8 micrometers. The treated silica particles comprise the reaction product of the hydrolyzed silane and silanol groups on the surface of the silica particles. The resulting dispersion was then filtered and applied to a photoconductive imaging member to form an anti-curl coating containing 2.5 percent by weight treated silica particles based on the total weight of the dried anti-curl coating. The dried anti-curl coating had a thickness of about 13.5 micrometers.

EXAMPLE XII

A photoconductive imaging member having two electrically operative layers as described in Example II was prepared using the same procedures and materials except that 9.9 grams of $NH_2(CH_2)_3$-Si-$(OC_2H_5)_3$ (3 aminopropyltriethoxysilane) treated crystalline silica particles was substituted for the treated silica described in Example II. The silica particles (Malvern 337, available from Malvern Minerals Co. in untreated form) had an irregular shape and an average particle size of about 2.8 micrometers. The treated silica particles comprise the reaction product of the hydrolyzed silane and silanol groups on the surface of the silica particles. The resulting dispersion was then filtered and applied to a photoconductive imaging member to form an anti-curl coating containing 10 percent by weight treated silica particles based on the total weight of the dried anti-curl coating. The dried anti-curl coating had a thickness of about 13.5 micrometers.

EXAMPLE XIII

A photoconductive imaging member having two electrically operative layers as described in Example II was prepared using the same procedures and materials except that 4.95 grams of $NH_2(CH_2)_3$-Si-$(OC_2H_5)_3$ (3 aminopropyltriethoxysilane) treated crystalline silica particles was substituted for the treated silica described in Example II. The silica particles (Malvern 337, available from Malvern Minerals Co. in untreated form) had an irregular shape and an average particle size of about 2.8 micrometers. The treated silica particles comprise the reaction product of the hydrolyzed silane and silanol groups on the surface of the silica particles. The resulting dispersion was then filtered and applied to a photoconductive imaging member to form an anti-curl coating containing 5 percent by weight treated silica particles based on the total weight of the dried anti-curl coating. The dried anti-curl coating had a thickness of about 13.5 micrometers.

EXAMPLE XIV

A photoconductive imaging member having two electrically operative layers as described in Example II was prepared using the same procedures and materials except that 2.5 grams of $NH_2(CH_2)_3$-Si-$(OC_2H_5)_3$ (3 aminopropyltriethoxysilane) treated crystalline silica particles was substituted for the treated silica described in Example II. The silica particles (Malvern 337, available from Malvern Minerals Co. in untreated form) had an irregular shape and an average particle size of about 2.8 micrometers. The treated silica particles comprise the reaction product of the hydrolyzed silane and silanol groups on the surface of the silica particles. The resulting dispersion was then filtered and applied to a photoconductive imaging member to form an anti-curl coating containing 2.5 percent by weight treated silica particles based on the total weight of the dried anti-curl coating. The dried anti-curl coating had a thickness of about 13.5 micrometers.

EXAMPLE XV

The anti-curl layers of the photoconductive imaging members of Examples I, II, XII, XIII, and XIV were tested for peel strength. Peel strength was determined by cutting a minimum of five 0.5 in×6 in imaging member samples. For each sample, the anti-curl layer was partially stripped from the supporting polyester substrate to about 3.5 in from one end to expose part of the underlying polyester substrate. The exposed surface of the polyester substrate was secured to a 1 in×6 in×0.5 in aluminum backing plate with the aid of two sided adhesive tape and the end of resulting assembly opposite the the end from which the anti-curl layer was not stripped was inserted into the upper jaws of an Instron Tensile Tester. The free end of the partially peeled anti-curl layer was inserted into the lower jaws of the Instron Tensile Tester. The jaws were then activated at a 1 in/min crosshead speed, a 2 in chart speed and a load range of 200 g to peel the sample at least 2 in. The load was plotted versus the peel strength and the peel strength was determined to be the minimum load required for stripping.

| Example | Anti-curl Layer on Substrate Peel Strength (gr/cm) |
|---|---|
| I (1% PE-100) | 15.6 |
| II (8% PE-200) | 160.0 |
| XII (8% PE-200 + 10% silica) | 310.0 |
| XIII (8% PE-200 + 5% silica) | 250.0 |
| XIV (8% PE-200 + 2.5% silica) | 203.0 |

These test results clearly demonstrate the improvement in adhesion due to the addition of PE-200 with and without silica.

EXAMPLE XVI

Photoreceptors were prepared as described in Example II except that different percentages of PE-200 were employed in the anti-curl backing layer. The resulting photoreceptors were tested as described in Example XV. The test results are shown in the Table below:

| Copolyester in Anti-curl Layer | Anti-curl Layer on Substrate Peel Strength (gr/cm) |
|---|---|
| 1% PE-100 | 15.6 |
| 3% PE-200 | 20.0 |
| 5% PE-200 | 113.0 |
| 7% PE-200 | 150.0 |
| 10% PE-200 | 178.0 |
| 30% PE-200 | 320.0 |

These test results show the improvement in adhesion due to increasing amounts of PE-200 without silica.

EXAMPLE XVII

Photoreceptors were prepared as described in Example I except that different percentages of PE-100 were employed in the anti-curl backing layer. The resulting photoreceptors were tested as described in Example XV. The test results are shown in the Table below:

| Copolyester in Anti-curl Layer | Anti-curl Layer on Substrate Peel Strength (gr/cm) |
|---|---|
| 1% PE-100 | 15.6 |
| 3% PE-100 | 10.2 |
| 5% PE-100 | 8.7 |
| 10% PE-100 | 8.0 |

These test results show the reduction in adhesion due to increasing amounts of PE-100 without silica.

EXAMPLE XVIII

The anti-curl layers of the photoconductive imaging members of Examples I, II, XII, XIII, and XIV were tested for coefficient of friction. The coefficient of friction test was conducted by fastening the photoconductive imaging member to be tested to the flat surface of the bottom of a horizontally sliding 200 gram weight. The weight was dragged in a straight line on a flat horizontal test surface with the outer surface of the anti-curl layer facing downwardly. The weight was moved by a cable which had one end fastened to the weight and the other end threaded around a low friction pulley. The pulley was positioned so that the segment of the cable between the weight and the pulley is parallel to the surface of the flat horizontal test surface. The cable was pulled vertically upward from the pulley by an Instron Tensile Tester. The charge transport layer (CTL) material was used on the flat horizontal test surface for the friction tests.

| Example | Coefficient of Friction Against CTL | |
|---|---|---|
| | Static | Dynamic |
| I (1% PE-100) | 3.4 | 1.00 |
| II (8% PE-200) | 3.4 | 0.97 |
| XII (8% PE-200 + 10% silica) | 0.61 | 0.56 |
| XIII (8% PE-200 + 5% silica) | 0.65 | 0.60 |
| XIV (8% PE-200 + 2.5% silica) | 0.64 | 0.58 |

These test results show the reduction in coefficient of friction due to increasing amounts of silica.

EXAMPLE XIX

Photoreceptors were prepared as described in Example II except that different percentages of PE-200 were employed in the anti-curl backing layer. The resulting photoreceptors were tested as described in Example XVIII. The test results are shown in the Table below:

| Copolyester in Anti-curl Layer | Coefficient of Friction Against CTL | |
|---|---|---|
| | Static | Dynamic |
| 1% PE-100 | 3.4 | 1.0 |
| 3% PE-200 | 3.5 | 0.95 |
| 5% PE-200 | 3.3 | 0.98 |
| 7% PE-200 | 3.4 | 0.96 |
| 10% PE-200 | 3.5 | 0.98 |
| 30% PE-200 | 3.5 | 0.96 |

These test results show that changes in the proportion of PE-200 has no significant effect on coefficient of friction.

EXAMPLE XX

Photoreceptors were prepared as described in Example II except that different percentages of PE-200 were employed in the anti-curl backing layer. The resulting photoreceptors were tested for Young's Modulus. Young's Modulus was determined by cutting a minimum of five 1.27 cm×10.16 cm imaging member samples, inserting each sample into the jaws of an Instron Tensile Tester using a 5.08 cm gage, and pulling the sample to full scale using a 0.51 mm/min crosshead speed, a 50.8 cm chart speed and a 453.6 gm full scale. The best straight line was drawn using the relationship:

$$E = \sigma/\epsilon$$

$$\text{where } \sigma = \frac{\text{force(453.6 g)}}{\text{sample area}}$$

and $$\epsilon = \frac{\Delta l}{l_o} = \frac{\text{change in length at } F = 453.6 \text{ g}}{\text{gage length}}$$

The test results are shown in the Table below:

| Copolyester in Anti-curl Layer | Modulus (kg/cm$^2$) |
|---|---|
| 1% PE-100 | $1.48 \times 10^4$ |
| 3% PE-200 | $1.48 \times 10^4$ |
| 5% PE-200 | $1.50 \times 10^4$ |
| 7% PE-200 | $1.48 \times 10^4$ |
| 10% PE-200 | $1.51 \times 10^4$ |
| 30% PE-200 | $1.52 \times 10^4$ |

These test results show that changes in the proportion of PE-200 has no significant effect on Young's Modulus.

EXAMPLE XXI

Photoreceptors were prepared as described in Example II except that the anti-curl layer is the only coating applied to an uncoated polyethylene terephthalate (Melinex, available from ICI Inc.) substrate having a thickness of 3 mils (76.1 micrometers). The dried thickness of the anti-curl layer was 14 micrometers. The size of each sample was 20 cm×28 cm. The coated substrate curled into a tubular shape upon drying. The amount of curling was quantified in terms of the diameter of the tubes. The test results are shown in the Table below:

| Copolyester in Anti-curl Layer | Diameter of Curvature (cm) |
|---|---|
| 1% PE-100 | 3.81 |
| 3% PE-200 | 3.81 |
| 5% PE-200 | 3.81 |
| 7% PE-200 | 3.81 |
| 10% PE-200 | 3.81 |
| 30% PE-200 | 3.81 |

These tests demonstrate that the counter-curling effect of the anti-curl layer is independent of the concentration of copolyester.

EXAMPLE XXII

The anti-curl coating coatings of Examples II and VII were tested for resistance to wear. Testing was effected by means of a dynamic mechanical cycling device in which glass tubes were skidded across the outer surface of the anti-curl coating on each photoconductive imaging member. More specifically, one end of the belt was clamped to a stationary post and the belt looped upward over three horizontal glass tubes and then downwardly over a stationary guide tube through an generally inverted "U" shaped path with the free end of the belt secured to a weight which provided one pound per inch width tension on the belt. The side of the electrophotographic imaging member bearing the anti-curl coating was allowed to contact the glass tubes. The glass tubes had a diameter of one inch. Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated, two glass tubes were maintained in sliding contact with the surface of the anti-curl layer as the disks were rotated about the shaft. The axis of each glass tube was positioned about 4 cm from the shaft. The direction of movement of the glass tubes along the anti-curl layer was away from the weighted end of the belt toward the end clamped to the stationary post. Since there were three glass tubes in the test device, each cycle of the disk was equivalent to three machine cycles in which the surface of the anti-curl coating is in sliding contact with a single stationary support tube during each xerographic cycle. The rotation of the spinning disk was adjusted to provide the equivalent of 11.3 inches per second belt speed. This test simulated the conditions in a high speed electrophotographic duplicator in which a stationary support bar is employed to support the belt. The results of this wear test after 330,000 cycles are described in the Table below:

| Example | Amount of Wear after 330,000 Cycles |
|---|---|
| II (8% PE-200) | 9.5 micrometers |
| XII (8% PE-200 + 10% silica) | ≦10 |

The data in the Table illustrates that the addition of crystalline silica particles treated with a bifunctional coupling agent markedly improves the resistance to wear of the anti curl layer. The anti-curl layer of the control Example exhibited about 900 percent greater wear than the anti curl layer containing 10 percent by weight treated silica.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A flexible electrophotographic imaging member comprising at least one electrophotographic imaging layer, a supporting substrate layer having an electrically conductive surface and an anti-curl layer, said anti-curl layer comprising a film forming binder and from about 3 percent by weight to about 30 percent by weight, based on the total weight of said anti-curl backing layer, of a copolyester resin reaction product of terephthalic acid, isophthalic acid, ethylene glycol and 2,2-dimethyl-1-propane diol, wherein the weight ratio of said terephthalic acid to said isophthalic acid is between about 2:1 to 1:1 and wherein the weight ratio of said ethylene glycol to said 2,2-dimethyl-1-propane diol is between about 2:1 to about 1:1.

2. A flexible electrophotographic imaging member according to claim 1 wherein said copolyester resin reaction product has a glass transition temperature of between about 40° C. and about 100° C.

3. A flexible electrophotographic imaging member according to claim 1 wherein said copolyester resin reaction product has a glass transition temperature of between about 50° C. and about 80° C.

4. A flexible electrophotographic imaging member according to claim 1 wherein said copolyester resin reaction product has a glass transition temperature of between about 55° C. and about 70° C.

5. A flexible electrophotographic imaging member according to claim 1 wherein said copolyester resin reaction product has a weight average molecular weight of between about 25,000 and 100,000.

6. A flexible electrophotographic imaging member according to claim 1 wherein said copolyester resin reaction product has a weight average molecular weight of between about 30,000 to about 70,000.

7. A flexible electrophotographic imaging member according to claim 1 wherein said copolyester resin reaction product has a weight average molecular weight of between about 40,000 and about 55,000.

8. A flexible electrophotographic imaging member according to claim 1 wherein the diacid diol weight ratio of said copolyester resin reaction product is about 1:1.

9. A flexible electrophotographic imaging member according to claim 1 wherein said electrophotographic imaging layer comprises a charge generating layer and a charge transport layer.

10. A flexible electrophotographic imaging member according to claim 9 wherein said charge transport layer comprises an organic polymer and an aromatic amine compound having the general formula:

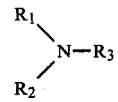

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms.

11. An electrophotographic imaging process comprising providing a flexible electrophotographic imaging member comprising at least one electrophotographic imaging layer, a supporting substrate layer having an electrically conductive surface and an anti-curl layer, said anti-curl layer comprising a film forming binder and from about 3 percent by weight to about 30 percent by weight, based on the total weight of said anti-curl backing layer, of a copolyester resin reaction product of terephthalic acid, isophthalic acid, ethylene glycol and 2,2-dimethyl-1-propane diol, wherein the weight ratio of said terephthalic acid to said isophthalic acid is between about 2:1 to 1:1 and wherein the weight ratio of said ethylene glycol to said 2,2-dimethyl-1-propane diol is between about 2:1 to about 1:1, forming an electrostatic latent image on said imaging surface, forming a toner image on said imaging surface in conformance with said electrostatic latent image and transferring said toner image to a receiving member.

12. An electrophotographic imaging process according to claim 11 comprising uniformly exposing said flexible electrophotographic imaging member to activating magnetic radiation directed through said anti-curl layer after transferring said toner image to said receiving member.

13. An electrophotographic imaging process according to claim 11 comprising cycling and flexing said anti-curl layer around a plurality of cylindrical support members while forming said electrostatic latent image on said imaging surface, forming said toner image, and transferring said toner image to said receiving member.

* * * * *